United States Patent [19]

Meier et al.

[11] 4,194,120

[45] Mar. 18, 1980

[54] ADJUSTABLE IONIZATION CHAMBER

[75] Inventors: Otto Meier, Hombrechtikon; Andreas Scheidweiler, Uerikon, both of Switzerland

[73] Assignee: Cerberus AG, Männedorf, Switzerland

[21] Appl. No.: 853,434

[22] Filed: Nov. 21, 1977

[30] Foreign Application Priority Data

Nov. 29, 1976 [CH] Switzerland ..... 15006/76

[51] Int. Cl.[2] ..... H01J 39/28

[52] U.S. Cl. ..... 250/381; 313/146; 313/149

[58] Field of Search ..... 250/381, 384; 313/146, 313/148, 269, 149; 340/629; 361/290, 291

[56] References Cited

U.S. PATENT DOCUMENTS

| | | | |
|---|---|---|---|
| 1,722,326 | 7/1929 | Dubilier | 361/291 |
| 1,729,704 | 10/1929 | Brokaw | 361/290 |
| 1,740,159 | 12/1929 | Dubilier | 361/290 |
| 1,743,019 | 1/1930 | Barone et al. | 361/290 |
| 2,179,068 | 11/1939 | Sprague | 361/291 |
| 3,710,110 | 1/1973 | Lampart et al. | 250/381 |
| 3,767,917 | 10/1973 | Lampart et al. | 250/385 |
| 3,909,815 | 9/1975 | Gacogne et al. | 250/381 |

*Primary Examiner*—Alfred E. Smith
*Assistant Examiner*—Carolyn E. Fields
*Attorney, Agent, or Firm*—Frishauf, Holtz, Goodman & Woodward

[57] ABSTRACT

An ionization chamber with two electrodes having a variable spacing and with a radioactive source for the ionization of the electrode gap therebetween includes an adjusting mechanism for the positional adjustment of one of the electrodes relative to the other. The mechanism is such that a spring element presses the adjustable electrode against at least one point of the adjusting mechanism.

Several arrangements are disclosed for adjustably mounting a cup-shaped electrode in the housing of the chamber in such a manner that it is readily adjustable and will not undergo spurious readjustment as a result of vibration of shock.

13 Claims, 13 Drawing Figures

ADJUSTABLE IONIZATION CHAMBER

BACKGROUND OF THE INVENTION

The present invention relates to an ionization chamber having two electrodes with a variable spacing and with a radioactive source for the ionization of the electrode gap, particularly for use in an ionization smoke detector.

Examples of ionization smoke detectors of the type involved here are described, for example, in the U.S. Pat. Nos. 3,710,110, issued Jan. 9, 1973 and 3,767,917, issued Oct. 23, 1973, both to Lampart et al.

In general, known ionization smoke detectors have two series-connected ionization chambers with different smoke sensitivities. For example, one of the chambers, normally called the measuring ionization chamber, is made extensively accessible to air, while the other chamber, normally called the reference ionization chamber, is essentially sealed against the atmosphere or screened against air access. In such ionization smoke detectors, use is made of the fact that when heavier particles, e.g. of smoke, penetrate into the chamber, the stream of atmospheric ions formed by the radioactive source and which flows between the electrodes is reduced. As a result, the chamber resistance rises. As the reference ionization chamber is not or only slightly influenced by smoke, if at all, its stream of ions remains virtually constant, particularly when in the saturation range. Therefore, when the voltage drop in the measuring ionization chamber increases upon penetration of smoke into the chamber, an evaluation circuit connected to the chamber gives an alarm signal after its voltage drop has exceeded a predetermined threshold value.

In practice, it is often necessary to be able to modify the threshold value, and consequently the sensitivity, of such an ionization smoke detector to adapt it to ambient conditions. This can be brought about electrically on the one hand by modifying the evaluation circuit and on the other by varying the stream of ions or the resistance of one of the two ionization chambers.

Various ionization smoke detectors are already known in which the stream of ions or the resistance of either the measuring ionization chamber or the reference ionization chamber is modified by changing the spacing of the two electrodes.

For example, the British Pat. No. 1,446,780 to Gacogne, published Aug. 18, 1976 and the Australian Pat. No. 402,078 to Ashwin published Apr. 26, 1968 describe detectors with an ionization chamber in which the electrode spacing may be adjusted by means of an adjusting screw. The British Pat. No. 1,088,976 published Oct. 25, 1967 discloses a detector with an ionization chamber in which the electrode spacing may be adjusted and fixed by means of a locking screw which, however, is not accessible from outside the detector.

When changing the sensitivity of an ionization smoke detector, preference is given to changing that of the reference ionization chamber, because in this case there is no need to influence the geometrical conditions, and consequently the smoke sensitivity, of the measuring ionization chamber.

In known ionization chambers such a modification to the electrode spacing is generally brought about by fixing one electrode to a screw which is passed through the rigid chamber casing and which can be turned from the rear wall of the chamber. However, such an adjustment by means of a simple screw thread has the disadvantage that over a period of time, and particularly under the action of vibrations or shocks, the setting changes by itself. Thus, a smoke detector equipped with such an ionization chamber is not operationally reliable over a period of time, unless the adjusting screw is locked, e.g. with a thread setting compound. As a result, once it is locked, the sensitivity cannot be readily adapted to other conditions. In other known ionization chambers with spacing adjustment, only a small electrode plate is placed on the adjusting screw, obviously for stability reasons. Thus, the change to the stream of ions which can be brought about by varying the electrode gap is much smaller than in the case of larger electrode dimensions and can in no way be considered optimum. A further disadvantage is that such adjustment mechanisms require a large amount of space outside the ionization chambers and can therefore undesirably increase the overall dimensions of an ionization smoke detector.

SUMMARY OF THE INVENTION

The problem of the invention is to eliminate the above-indicated disadvantages and provide an ionization chamber in which the stream of ions can be changed by modifying the electrode spacing in a simple, reliable and extremely efficient manner without there being any danger of a spurious readjustment over a period of time under the influence of vibrations and shocks, whereby the space requirements are reduced and the stability and operational reliability are increased.

According to the present invention this problem is solved in that an adjusting mechanism for varying the position of one of the electrodes relative to the other is constructed and positioned in such a way that a spring element presses the adjustable electrode against at least one point of the adjusting mechanism.

DESCRIPTION OF THE PREFERRED EMBODIMENTS

Figure 1A:
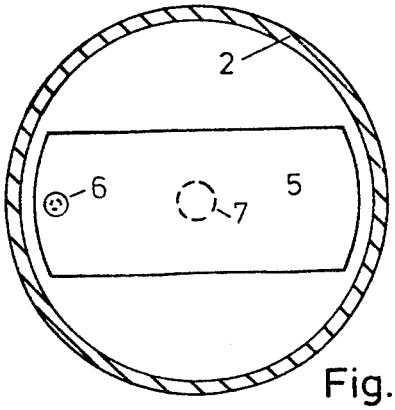
FIG. 1*a* is a radial section through an ionization chamber in accordance with a first embodiment of the present invention and having an adjustable electrode.
Figure 1B:
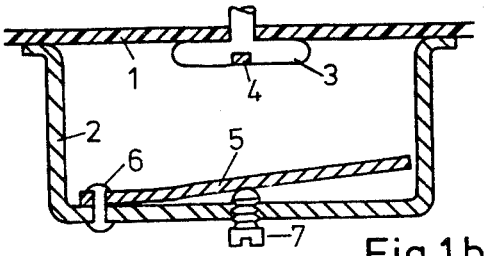
FIG. 1*b* is a side section of the chamber of FIG. 1.

In the case of the embodiment shown in FIGS. 1*a* and 1*b*, the ionization chamber is enclosed by a cup 2, made from plastic or preferably metal, mounted on a plastic mounting plate 1. A central electrode 3 carrying a radioactive source 4 is inserted in mounting plate 1. The radioactive source can also be located at another point in the chamber in such a way that the inside of the chamber is adequately ionized. The other electrode is formed by an elastic metal strip 5, made for example of spring steel and resiliently fixed by means of a rivet 6 to cup 2. A setscrew 7 is provided in the bottom of cup 2, by means of which the electrode 5 can be forced out of the inoperative position, leading to a modification in the gap between electrodes 3 and 5 and consequently to the stream of ions. The spring tension of electrode 5 is selected in such a way that it is pressed with an adequate force against screw 7 or its thread to prevent the spurious adjustment of the latter, e.g. under the action of vibrations or shocks, thus providing a definite improvement relative to the prior art.

An ionization chamber of the above-described type is particularly suitable for use as a reference ionization chamber in an ionization smoke detector. Such reference ionization chambers are generally fitted to a mounting plate at the back of the detector. As the adjusting screw 7 is located on the bottom of the chamber, such an ionization smoke detector can be easily adjusted from behind by means of a screw-driver by modifying the electrode gap of the reference chamber, and its sensitivity can be regulated gradually to the desired value. However, it would also be possible to use it as the measuring ionization chamber of an ionization smoke detector, for which purpose the cup 2 would have to be penetrable by air. The sensitivity of such a detector can be changed in identical manner from the front. However, that would to a certain extent be disadvantageous since it would lead to a change in the chamber geometry and consequently to the smoke sensitivity. Therefore, it is preferably the reference ionization chamber, which is known manner is connected in series with the measuring chamber which is equipped with the adjusting mechanism.

Figure 2A:
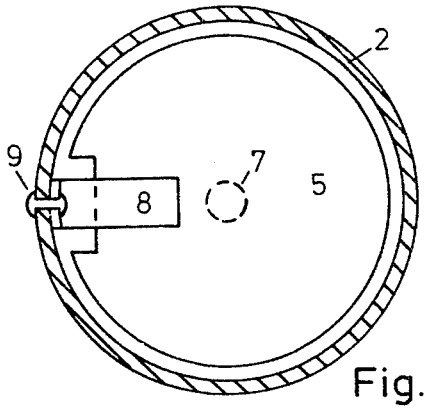
FIG. 2*a* is a radial section through an ionization chamber in accordance with a second embodiment of the present invention and also having an adjustable electrode.
Figure 2B:
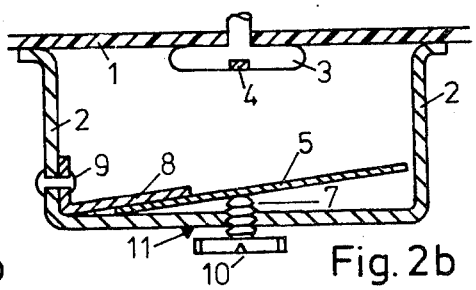
FIG. 2*b* is a side section of the chamber of FIG. 2*a*.

FIGS. 2*a* and 2*b* show a similarly constructed ionization chamber in which identical parts are given the same reference numerals as in FIG. 1. Unlike in the previous embodiment, in the ionization chamber according to FIG. 2, an electrode 5 is provided which takes up almost the entire base of the chamber. The sensitivity change obtained on varying the spacing of electrode 5 relative to central electrode 3 is therefore larger than in the previous embodiment with the strip-like electrode 5. It is also advantageous in this case that electrode 5 does not have to be made from resilient material, because it is pressed against setscrew 7 by means of a spring steel shackle 8 fixed to cup 2 by rivet 9. In the present embodiment, screw 7 is constructed as a knurled head screw which has a notch 10 at the top. The position of screw 7, and therefore the set sensitivity, may be indicated by marks 11 on the back of the chamber. Instead, it is also possible to provide individual locking positions.

Whereas in the case of the preceding embodiments the adjustable electrode 5 engaged with the base of the chamber at at least one point, the embodiment of FIGS. 3*a* to 3*d* shows an ionization chamber with an electrode 12 which over its entire length can be adjusted uniformly as regards height, and therefore spacing, relative to counterelectrode 3. To this end, electrode 12 is constructed in cup-shaped manner with a flat bottom and cylindrical side wall in such a way that it can slide up and down in cup 2. The movement of electrode 12 is limited by slots 13 in the cylindrical part and by pins 14 engaging through the slots on the cup wall. On the bottom of electrode 12, a slot 17 is provided into which can pass a screw-driver through a hole 18 in the bottom of cup 2. The turning of electrode 12 by means of a screw-driver leads to the adjustment of its height, and consequently the electrode gap, by means of the guide slots 13. Leaf springs 15 are fitted to the bottom of cup 2 by means of rivets 16 in such a way that by means of their spring tension they force electrode 12 upwards and consequently force pins 14 against the lower edge of guide slots 13. The compression springs 15 can be replaced by tension springs, so that pins 14 press against the upper edge of quide slots 13. The spring action in all cases prevents the spurious adjustment of the electrode gap. Since in this embodiment the friction of the adjusting mechanism is smaller, at least as compared with a screw thread, it is advantageous to provide an additional securing means. This comprises a pin 19 which, by means of a spring 20, is pressed through cup 2 and into h oles 21 in the cylindrical part of electrode 12. On turning electrode 12, pin 19 automatically engages in specified positions with a clearly defined electrode gap. This provides the additional advantage that the sensitivity can be adjusted in clearly defined stages.

Figure 3A:
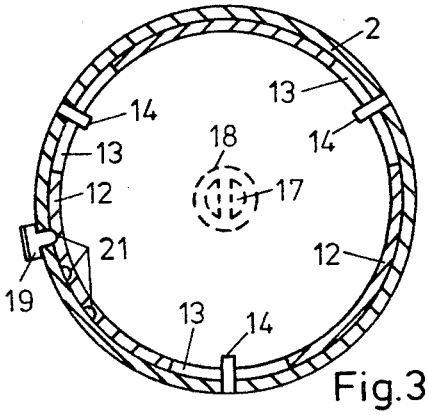
FIG. 3*a* is a radial section through an ionization chamber in accordance with a third embodiment of the present invention and having an inclined slit adjustment.
Figure 3C:
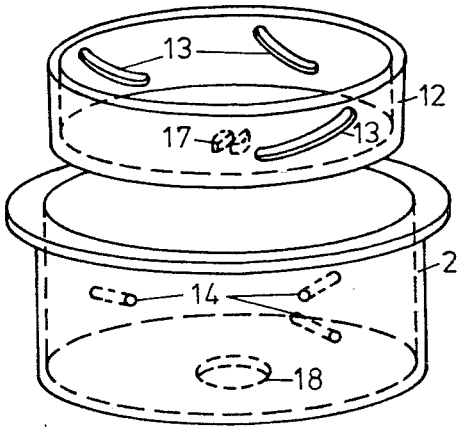
FIG. 3*c* is an exploded view of a portion of the chamber of FIGS. 3*a* and 3*b* with the top removed.
Figure 3B:
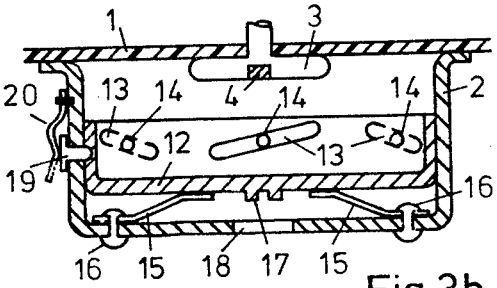
FIG. 3*b* is a side section of the chamber of FIG. 3*a*.
Figure 3D:
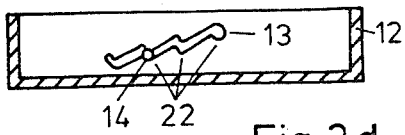
FIG. 3*d* is a side section of an internal element of the chamber of FIGS. 3*a*, 3*b* and 3*c*.
Figure 4A:
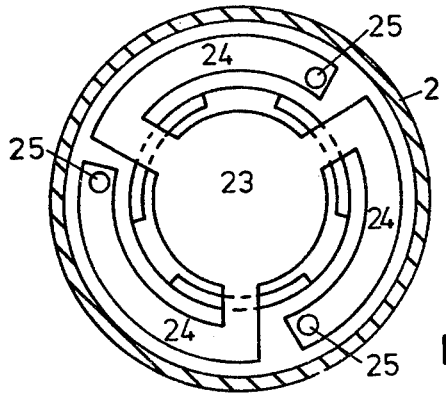
FIG. 4*a* is a radial section through an ionization chamber in accordance with a fourth embodiment of the present invention and having a cam adjustment.
Figure 4B:
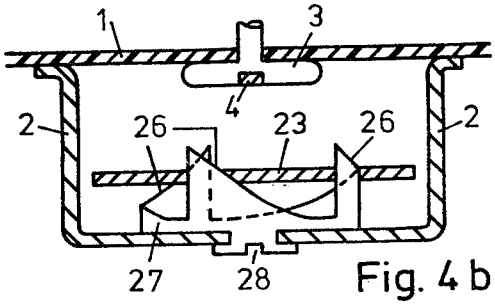
FIG. 4*b* is a partial side section of the chamber of FIG. 4*a*.
Figure 4E:
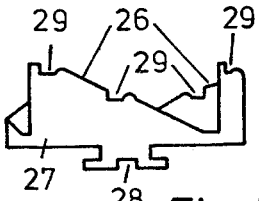
FIG. 4*e* is a side view of a third internal component of the chamber of FIG. 4*a*.
Figure 4C:
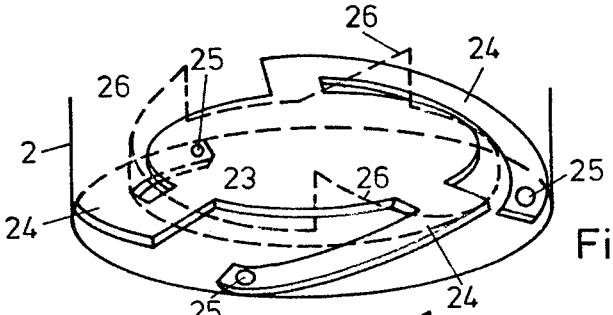
FIG. 4*c* is an elevational view of an internal component of the chamber of FIG. 4*a*.
Figure 4D:
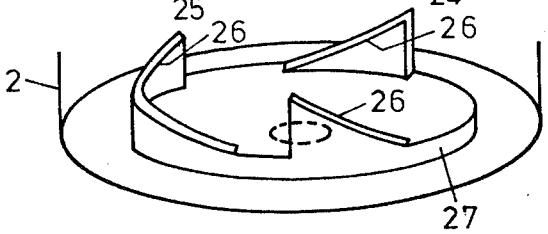
FIG. 4*d* is an elevational view of another internal component of the chamber of FIG. 4*a*.

As shown in FIG. 3*d* this result can also be brought about by a corresponding construction of the guide slots 13 in place of engagement holes. In this case, the edges of the guide slots are not linear but instead have a plurality of locking points 22 into which the pins 14 can engage.

If springs 20 have an adequate spring tension, it may be possible to eliminate springs 15.

A further advantage of the embodiment of FIGS. 3*a* and 3*d* is that the adjusting mechanism is located entirely within the ionization chamber, i.e. requires no additional space. As a result, the overall dimensions of the ionization chamber can be kept particularly small.

In the embodiment of FIGS. 4*a* to 4*e*, the adjustable electrode comprises a central plate 23, which is not, however, fixed to the base of the chamber at only one point, but is instead fixed thereto at several points 25 by means of several spiral arms 24. Thus, the spring tension is smaller than when fixing a circular disc to several points of its periphery. In addition, the elasticity constant can be adjusted in accordance with requirements by a corresponding choice of the width and length of the spiral arms. It is also advantageous that in the case of electrode adjustment, the central plate 23 which forms the preponderant part of the effective electrode surface is not inclined, and consequently during electrode adjustment the sensitivity change remains largely linear.

In this embodiment the adjusting mechanism comprises a plurality of cam plates 26, located on a cylindrical surface and whose number corresponds to the number of spiral arms 24. The diameter of the cylindrical surface is selected in such a way that the cams engage between electrode plate 23 and spiral arms 24 in such a way that the inclined cams 26 displace upwardly from the inoperative position the attachment points of spiral arms 24 on plate 23. Here again, the spring tension of spiral arms 24 acts against any adjustment, so that a spurious adjustment through friction between the cam and the electrode is prevented. Since cams 26 are fitted to a base plate 27, which is rotatable through the bottom of the chamber means of a slot 28, it is once again possible to adjust the height of electrode plate 23 in a continuous and reliable manner by turning from the back of the chamber a screw-driver which passes through slot 28.

Instead of having a linear edge, the cams 26 can also be constructed in such a way that there are a plurality of locking points 29 in which engage the extension pieces of spiral arms 24. This once again leads to a reliable and accurate stepwise sensitivity adjustment, and spurious adjustment under the action of vibrations, and shocks can be even more reliably prevented. An ionization smoke detector equipped with such an ionization chamber can be easily and reliably adjusted to several sensitivity stages by untrained personnel, so that the selected sensitivity setting is reliably maintained even over long periods.

We claim:

1. An ionization chamber with two electrodes having a variable spacing, with a radioactive source for the ionization of the electrode gap therebetween, and with an adjusting mechanism for the positional adjustment of one of the electrodes relative to the other being constructed and positioned in such a way that a spring element presses the adjustable electrode against at least one point of the adjusting mechanism, wherein the adjustable electrode is constructed in cup-shaped manner and has a flat base and cylindrical sides in which guide slots are provided into which extend fixed pins and wherein the cup-shaped electrode rotates about its axis.

2. An ionization chamber according to claim 1, wherein the adjustable cup-shaped electrode rests on the adjusting mechanism by means of spring elements which on one side engage a housing and on the other side engage the cup-shaped electrode.

3. An ionization chamber according to claim 1, wherein:

the adjustable cup-shaped electrode has a flat base and cylindrical sides, guide slots are provided in the cylindrical sides, guide pins fixed to the housing extend into the slots, the cup-shaped electrode rotates about its axis, a plurality of holes are provided in the cylindrical part of the cup-shaped electrode, and a locking pin is arranged so that it can selectively extend into and be resiliently held in one of the holes to fix the rotational position of the electrode.

4. An ionization chamber according to claim 1, wherein the adjustable cup-shaped electrode has with a flat base and cylindrical sides, guide slots are provided in the cylindrical sides, guide pins fixed to the housing extend from the housing into the guide slots, the cup-shaped electrode rotates about its axis, and the guide slots have locking points for retaining the electrode in a desired position relative to the guide pins.

5. An ionization chamber according to claim 1, wherein the housing surrounds the ionization chamber and the adjusting mechanism has a screw thread which passes through the base of the housing.

6. An ionization chamber according to claim 1, wherein the ionization chamber is fitted to the back of a mounting plate of an ionization smoke detector.

7. An ionization chamber according to claim 1, wherein the adjusting mechanism is constructed in such a way, and so arranged in an ionization smoke detector, that it is operable from outside the ionization smoke detector.

8. An ionization chamber with two electrodes having a variable spacing, with a radioactive source for the ionization of the electrode gap therebetween, and with an adjusting mechanism for the positional adjustment of one of the electrodes relative to the other being constructed and positioned in such a way that a spring element presses the adjustable electrode against at least one point of the adjusting mechanism, wherein the adjustable electrode comprises a plate-shaped part to which are fixed a plurality of spiral arms secured in elastically resilient manner by their ends to the bottom of the chamber housing and forms a unitary spring element - electrode combination.

9. An ionization chamber according to claim 8, wherein the ionization chamber is fitted to the back of a mounting plate of an ionization smoke detector.

10. An ionization chamber according to claim 8, wherein the adjusting mechanism is constructed in such a way, and so arranged in a ionization smoke detector, that it is operable from outside the ionization smoke detector.

11. An ionization chamber according to claim 8, wherein the adjusting mechanism comprises cams arranged in a cylindrical surface, whose number corresponds to the number of spiral arms and which engage in the spaces between extension pieces of the spiral arms on the electrode plate.

12. An ionization chamber according to claim 11, wherein the cams are fitted to a base plate which through the bottom of the housing can be rotated about the cylindrical axis.

13. An ionization chamber according to claim 11, wherein the cams have locking points in which can engage the extension pieces of the spiral arms.

* * * * *